US007995044B2

(12) United States Patent
Moon et al.

(10) Patent No.: US 7,995,044 B2
(45) Date of Patent: Aug. 9, 2011

(54) DISPLAY DEVICE

(75) Inventors: Seung-Hwan Moon, Yongin-si (KR); Nam-Soo Kang, Ansan-si (KR); Su-Hyun Kwon, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1058 days.

(21) Appl. No.: 11/461,866

(22) Filed: Aug. 2, 2006

(65) Prior Publication Data

US 2007/0030225 A1 Feb. 8, 2007

(30) Foreign Application Priority Data

Aug. 3, 2005 (KR) ..... 10-2005-0070958

(51) Int. Cl.
*G09G 3/36* (2006.01)

(52) U.S. Cl. ..... 345/204; 345/87; 345/98; 345/99; 345/100; 341/55; 341/93

(58) Field of Classification Search ..... 345/89, 345/96, 690, 209, 204, 205, 87, 98, 99, 100; 341/55, 93

See application file for complete search history.

(56) References Cited

U.S. PATENT DOCUMENTS

| | | | | |
|---|---|---|---|---|
| 5,438,342 | A * | 8/1995 | Yamaguchi | 345/58 |
| 5,748,902 | A * | 5/1998 | Dalton et al. | 709/246 |
| 6,335,718 | B1 * | 1/2002 | Hong et al. | 345/98 |
| 6,388,651 | B1 * | 5/2002 | Kinoshita et al. | 345/98 |
| 6,657,622 | B2 * | 12/2003 | Park | 345/205 |
| 6,671,212 | B2 * | 12/2003 | Macri et al. | 365/189.07 |
| 6,795,047 | B2 * | 9/2004 | Kudo et al. | 345/87 |
| 6,930,665 | B2 * | 8/2005 | Sekine | 345/100 |
| 7,061,418 | B2 * | 6/2006 | Zebedee | 341/150 |
| 7,102,609 | B2 * | 9/2006 | Saitou et al. | 345/98 |
| 7,259,741 | B2 * | 8/2007 | Morita et al. | 345/98 |
| 7,456,814 | B2 * | 11/2008 | Lee et al. | 345/96 |
| 7,839,397 | B2 * | 11/2010 | Moriyama et al. | 345/204 |
| 2001/0003447 | A1 * | 6/2001 | Murai et al. | 345/99 |
| 2002/0003521 | A1 * | 1/2002 | Matsueda et al. | 345/89 |
| 2002/0060657 | A1 * | 5/2002 | Matsueda et al. | 345/89 |
| 2002/0135556 | A1 | 9/2002 | Nakajima et al. | |
| 2002/0163591 | A1 | 11/2002 | Tsutsui | |
| 2003/0030604 | A1 | 2/2003 | Moon et al. | |

(Continued)

FOREIGN PATENT DOCUMENTS

CN 1573459 2/2005

(Continued)

*Primary Examiner* — Richard Hjerpe
*Assistant Examiner* — Gregory J Tryder
(74) *Attorney, Agent, or Firm* — H.C. Park & Associates, PLC

(57) ABSTRACT

A display device with reduced power consumption has pixels coupled with data lines and arranged in a matrix, a signal controller processing input image signals and outputting output image signals, and a data driver applying data voltages, corresponding to output image signals, to the data lines. When all the input image signals have either a first or second value, the output image signals have the first value. The signal controller generates a polarity signal for determining data voltage polarity, and when all the input image signals have either a first or second value, data voltages corresponding to the input image signals have a polarity equivalent to a polarity of previously applied data voltages. The signal controller generates a control signal for controlling the data driver's clock synchronization circuit, and the control signal halts the clock synchronization circuit when an operating frequency is lower than a predetermined value.

16 Claims, 9 Drawing Sheets

U.S. PATENT DOCUMENTS

| | | | | |
|---|---|---|---|---|
| 2003/0043100 | A1* | 3/2003 | Moon | 345/87 |
| 2004/0070581 | A1* | 4/2004 | Hiraki et al. | 345/209 |
| 2004/0135757 | A1* | 7/2004 | Park et al. | 345/98 |
| 2005/0083278 | A1* | 4/2005 | Teraishi | 345/87 |
| 2006/0097967 | A1* | 5/2006 | Lee | 345/87 |
| 2006/0119596 | A1* | 6/2006 | Lin | 345/211 |
| 2007/0040821 | A1* | 2/2007 | Senda et al. | 345/204 |

FOREIGN PATENT DOCUMENTS

| | | | |
|---|---|---|---|
| JP | 2001290460 | A1 | 10/2001 |
| JP | 2002311902 | A1 | 10/2002 |
| JP | 2003084721 | A1 | 3/2003 |
| JP | 2003233351 | A1 | 8/2003 |
| JP | 2004012891 | A1 | 1/2004 |
| JP | 2005092181 | A1 | 4/2005 |
| KR | 1020000074515 | A1 | 12/2000 |
| KR | 1020020056692 | A1 | 7/2002 |
| KR | 1020020057799 | A1 | 7/2002 |
| KR | 1020020094637 | A1 | 12/2002 |
| KR | 1020030072723 | A1 | 9/2003 |
| KR | 1020030086047 | A1 | 11/2003 |
| KR | 1020040026009 | A1 | 3/2004 |
| KR | 1020040062183 | A1 | 7/2004 |
| KR | 100465471 | B1 | 12/2004 |
| KR | 1020050015028 | A1 | 2/2005 |

* cited by examiner

DISPLAY DEVICE

CROSS REFERENCE TO RELATED APPLICATION

This application claims the benefit of and priority to Korean Patent Application Number 10-2005-0070958, filed on Aug. 3, 2005, which is hereby incorporated by reference for all purposes as if fully set forth herein.

BACKGROUND OF THE INVENTION

1. Field of the Invention

The present invention relates to a display device, and more particularly, to an active matrix display device with reduced power consumption.

2. Discussion of the Background

Flat panel displays such as plasma display panels (PDP), liquid crystal displays (LCD), and organic light emitting diode (OLED) displays have recently been used as a substitute for traditional cathode ray tube (CRT) displays.

Of the various types of flat panel displays, an active matrix display device, such as an LCD or an OLED display, may include a panel having a plurality of pixels. The panel may also include switching elements, such as thin film transistors (TFTs), and a plurality of signal lines, such as gate lines and data lines, connected to the switching elements. The active matrix display device may also include a gate driver that applies gate signals to the gate lines for turning the switching elements on and off, a data driver that converts image data into data signals and applies the data signals to the data lines, and a signal controller that supplies the image data to the data driver and controls the gate driver and the data driver.

Recently, the image data supplied from the signal controller to the data driver has been transmitted in a current representation scheme rather than a voltage representation scheme. The current representation scheme may use "0" in a bit of digital image data to represent a first current value I and "1" in a bit of digital image data to represent a second current value 3I, which may be equal to three times the first current value.

In addition, a point-to-point cascading interface, which is often referred to as a wise bus, between the signal controller and the data driver may be incorporated to reduce power consumption.

However, in a portable display device, such as a notebook computer, there may be a need to further reduced power consumption.

SUMMARY OF THE INVENTION

This invention provides a display device with reduced power consumption.

Additional features of the invention will be set forth in the description which follows, and in part will be apparent from the description, or may be learned by practice of the invention.

The present invention discloses a display device including a plurality of pixels arranged in a matrix, a plurality of data lines coupled with the pixels, a signal controller processing input image signals and outputting output image signals, a gray voltage generator generating a plurality of gray voltages, and a data driver selecting data voltages from the gray voltages corresponding to the output image signals received from the signal controller, and applying the data voltages to the plurality of data line. When all the input image signals have either a first value or a second value, the signal controller outputs output image signals having the first value.

The present invention discloses a display device including a plurality of pixels arranged in a matrix, a plurality of data lines coupled with the pixels, a signal controller processing input image signals into output image signals, a gray voltage generator generating a plurality of gray voltages, and a data driver selecting data voltages from the gray voltages corresponding to the output image signals output from the signal controller, and applying the data voltages to the data lines in sequence. Further, the signal controller generates a polarity signal for determining a polarity of the data voltages, and when all the input image signals have either a first value or a second value, data voltages corresponding to the input image signals applied to a row of pixels have the same polarity as data voltages applied to the previous row of pixels.

The present invention discloses a display device including a plurality of pixels arranged in a matrix, a plurality of data lines coupled with the pixels, a signal controller processing input image signals and outputting output image signals, a gray voltage generator generating a plurality of gray voltages, and a data driver comprising a clock synchronization circuit, the data driver for selecting data voltages from the gray voltages where data voltages correspond to the output image signals from the signal controller, and for applying the data voltages to the data lines. Further, the signal controller generates a control signal for controlling the clock synchronization circuit, and the control signal halts operation of the clock synchronization circuit when an operating frequency of the data driver is lower than a predetermined value.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
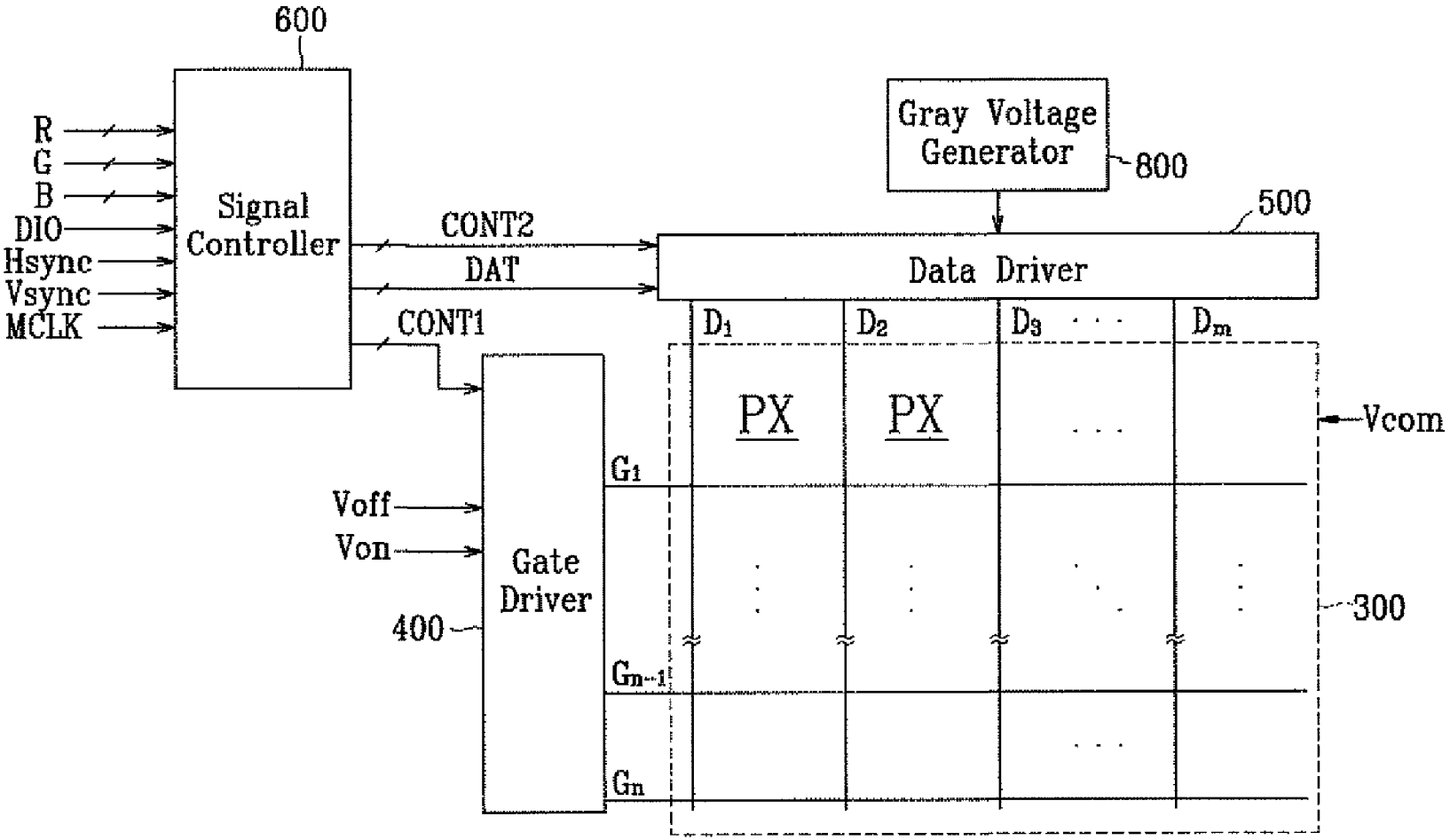
FIG. 1 shows a block diagram of an LCD according to an exemplary embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element such as a layer, film, region or substrate is referred to as being "on" another element, it can be directly on the other element or intervening elements may also be present. In contrast, when an element is referred to as being "directly on" another element, there are no intervening elements present.

An LCD as an example of a display device according to an exemplary embodiment of the present invention now will be described in detail with reference to FIG. 1, FIG. 2 and FIG. 3.

Figure 2:
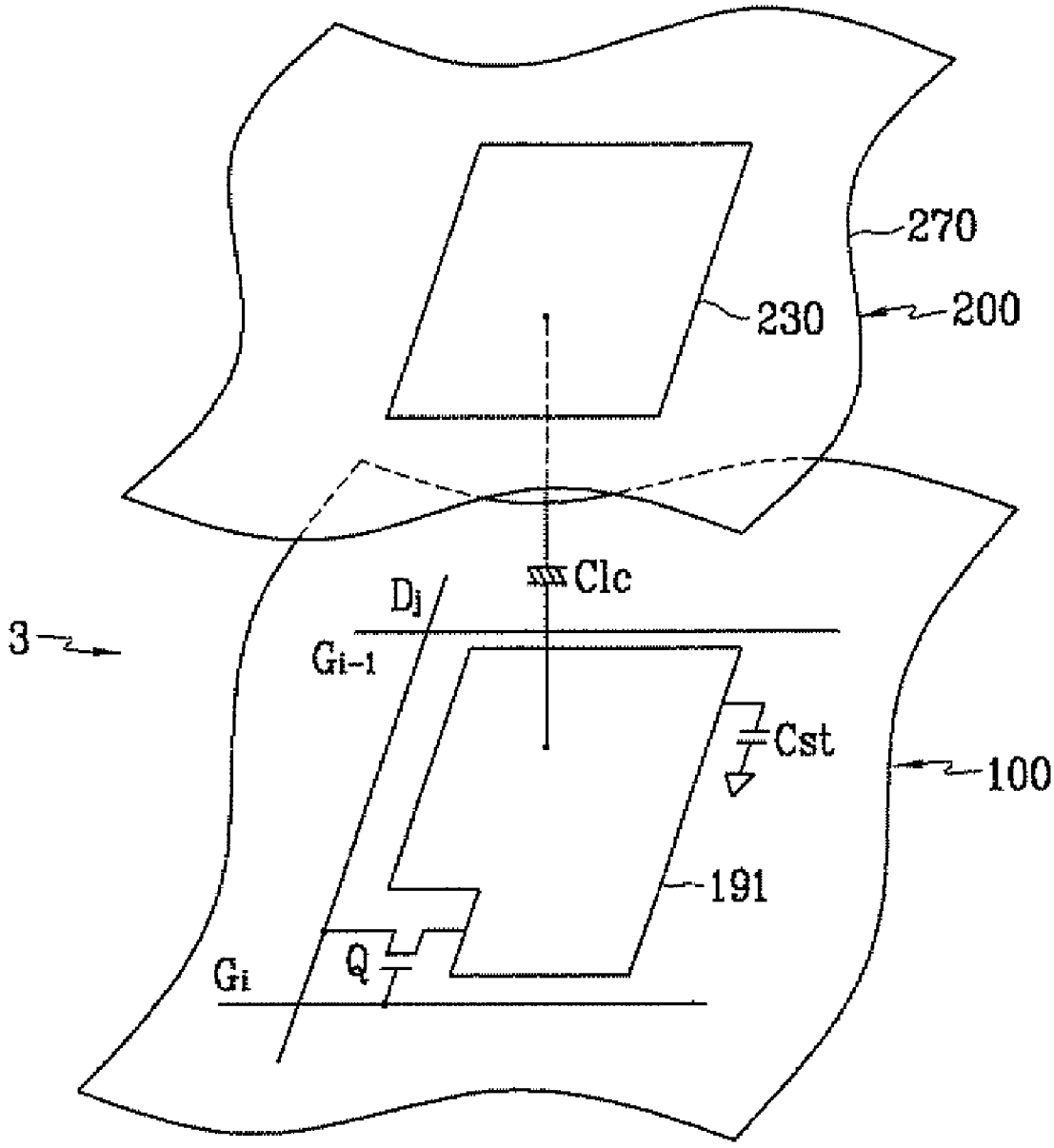
FIG. 2 shows an equivalent circuit diagram of a pixel of an LCD according to an exemplary embodiment of the present invention.
Figure 3:
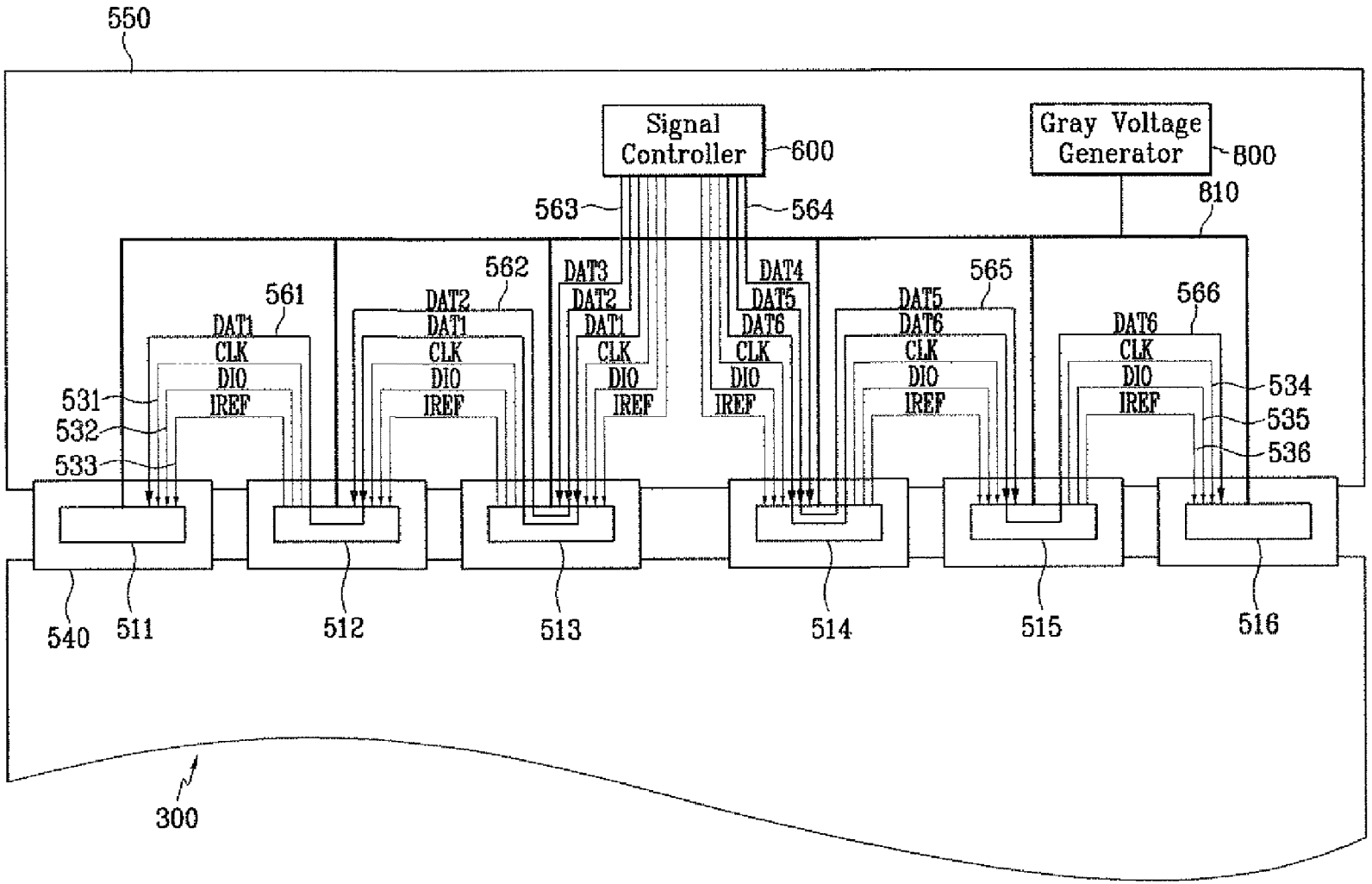
FIG. 3 shows a schematic diagram of an LCD according to an exemplary embodiment of the present invention.

FIG. 1 shows a block diagram of an LCD according to an exemplary embodiment of the present invention, FIG. 2 shows an equivalent circuit diagram of a pixel of an LCD according to an exemplary embodiment of the present invention, and FIG. 3 shows a schematic diagram of an LCD according to an exemplary embodiment of the present invention.

Referring to FIG. 1, an LCD according to an exemplary embodiment may include a liquid crystal (LC) panel assembly 300, a gate driver 400 coupled with the panel assembly 300, a data driver 500 coupled with the panel assembly 300, a gray voltage generator 800 coupled with data driver 500, and a signal controller 600 coupled with and controlling the above elements.

The panel assembly 300 may include a plurality of signal lines including gate lines $G_1$ to $G_n$ and data lines $D_1$ to $D_m$. The panel assembly 300 may also include a plurality of pixels PX arranged in rows and columns, substantially in a matrix. A pixel PX may be coupled with at least one of the gate lines $G_1$ to $G_n$ and at least one of the data lines $D_1$ to $D_m$. In the equivalent circuit diagram of a pixel PX shown in FIG. 2, the panel assembly 300 includes lower panel 100 and upper panel 200 facing each other and an LC layer 3 interposed between lower panel 100 and upper panel 200.

The signal lines may include a plurality of gate lines $G_1$ to $G_n$ for transmitting gate signals, also known as scanning signals, and a plurality of data lines $D_1$ to $D_m$ for transmitting data signals. The gate lines $G_1$ to $G_n$ may extend substantially horizontally along a row of pixels PX and may be arranged substantially parallel to each other, while the data lines $D_1$ to $D_m$ may extend substantially vertically along a column of pixels PX and may be arranged substantially parallel to each other.

Referring to FIG. 2, a single pixel PX may be connected to the i-th gate line $G_i$ (i=2, 3, . . . , n) and to the j-th data line $D_j$(j=1, 2, . . . , m) by a switching element Q. Switching element Q may be disposed on the lower panel 100, may have an input terminal connected to the data line $D_j$, and may have a control terminal connected to the gate line $G_i$. Pixel PX may have an LC capacitor Clc and a storage capacitor Cst that are both coupled with an output terminal of switching element Q. At least the storage capacitor Cst may be omitted. Switching element Q may be an element for turning on or turning off in response to a signal to determine whether current may flow across switching element Q. For example, switching element Q may be a TFT.

The LC capacitor Clc may include a pixel electrode 191 disposed on the lower panel 100 and a common electrode 270 disposed on the upper panel 200, where pixel electrode 191 is a first terminal of LC capacitor Clc and common electrode 270 is a second terminal of LC capacitor Clc. The LC layer 3 disposed between the pixel electrode 191 and the common electrode 270 may function as dielectric of the LC capacitor Clc. The pixel electrode 191 may be coupled with the switching element Q, and the common electrode 270 may be supplied with a common voltage Vcom and may cover an entire surface of the upper panel 200. Unlike as shown in FIG. 2, the common electrode 270 may be provided on the lower panel 100, and at least one of the pixel electrode 191 and the common electrode 270 may be disposed in the shape of a bar or a stripe. Further, common electrode 270 may be disposed to cover only a single pixel PX or a portion, such as a single row or a single column, of pixels PX on panel assembly 300.

The storage capacitor Cst may be an auxiliary capacitor for the LC capacitor Clc. The storage capacitor Cst may include the pixel electrode 191 and a separate signal line provided on the lower panel 100, where the separate signal line may overlap the pixel electrode 191 and may be separated via an insulator, and the separate signal line is supplied with a predetermined voltage such as the common voltage Vcom. Alternatively, the storage capacitor Cst may include the pixel electrode 191 and an adjacent gate line called a previous gate line $G_{i-1}$, which may overlap the pixel electrode 191 and may be separated via an insulator.

For a color display, each pixel PX of the panel assembly 300 may uniquely represent a primary color, known as spatial division, or each pixel may sequentially represent the primary colors in turn, known as temporal division. While driving the display panel, the spatial sum or temporal sum of the light emitting with the primary colors may be combined from the viewpoint of an observer and may be observed and recognized as a desired color. An example of a set of the primary colors may include red R, green G, and blue B. FIG. 2 shows an example of the spatial division where each pixel may include a color filter 230 representing one of the primary colors in an area of the upper panel 200 facing the pixel electrode 191. Alternatively, the color filter 230 may be provided on or under the pixel electrode 191 on the lower panel 100.

One or more polarizers (not shown) may further be attached to the panel assembly 300.

Referring to FIG. 1 and FIG. 3, a gray voltage generator 800 may be disposed on a printed circuit board (PCB) 550 and may generate two sets of reference gray voltages related to the transmittance of the pixels PX. The reference gray voltages in a first set of reference gray voltages may have a positive polarity with respect to the common voltage Vcom, while the reference gray voltages in a second set of reference gray voltages may have a negative polarity with respect to the common voltage Vcom.

The gate driver 400 may be coupled with the gate lines $G_1$ to $G_n$ of the panel assembly 300 and may synthesize a gate-on voltage Von and a gate-off voltage Voff to generate the gate signals for application to the gate lines $G_1$ to $G_n$.

The data driver 500 may include a plurality of data driving integrated circuits (ICs) 511, 512, 513, 514, 515 and 516, each mounted on flexible printed circuit (FPC) films 540, in a form of a chip. The data driving IC chips 511, 512, 513, 514, 515 and 516 may be coupled with the data lines $D_1$ to $D_m$ of the panel assembly 300 and may be coupled with the gray voltage generator 800 through voltage transmission lines 810. The data driver 500 may apply data signals, selected from the reference gray voltages supplied from the gray voltage generator 800, to the data lines $D_1$ to $D_m$. The gray voltage generator 800 may generate less than the number of all gray voltages necessary to display every variation of grays. In this instance, the data driver 500 may select or divide the reference gray voltages to generate all the gray voltages and generate the data signals from the gray voltages.

The data driving ICs 511, 512, 513, 514, 515 and 516 may be coupled with signal controller 600 in a point-to-point cascading interface to be supplied with and distribute image data signals DAT1, DAT2, DAT3, DAT4, DAT5, or DAT6. A first group of data driving ICs 511, 512 and 513 and a second group of data driving ICs 514, 515, and 516 may be disposed opposite to each other with respect to the signal controller 600.

The data driving ICs 511, 512, 513, 514, 515 and 516 may be supplied with image data signals DAT1, DAT2, DAT3, DAT4, DAT5, or DAT6 through data transmission lines 561, 562, 563, 564, 565, and 566, respectively, from the signal controller 600. Specifically, the data driving IC 511 may be supplied with image data signal DAT1 through data transmission line 561 from the signal controller 600. The data driving IC 512 may be supplied with image data signal DAT2 through data transmission line 562 from the signal controller 600. The data driving IC 513 may be supplied with image data signal DAT3 through data transmission line 563 from the signal controller 600. The data driving IC 514 may be supplied with image data signal DAT4 through data transmission line 564 from the signal controller 600. The data driving IC 515 may be supplied with image data signal DAT5 through data transmission line 565 from the signal controller 600. The data driving IC 516 may be supplied with image data signal DAT6 through data transmission line 566 from the signal controller 600.

The data driving ICs 511, 512, and 513 may each receive control signals CLK, DIO and IREF transmitted respectively through signal transmission lines 531, 532, and 533. The data driving ICs 514, 515, and 516 may receive control signals CLK, DIO and IREF transmitted respectively through signal transmission lines 534, 535, and 536.

First data transmission line 561 may end at a first data driving IC 511 after passing through second data driving IC 512 and third data driving IC 513. Second data transmission line 562 may end at a second data driving IC 512 after passing through third data driving IC 513. Third data transmission line 563 may end at a third data driving IC 513. Fourth data transmission line 564 may end at a fourth data driving IC 514. Fifth data transmission line 565 may end at a fifth data driving IC 515 after passing through fourth data driving IC 514. Sixth data transmission line 566 may end at a sixth data driving IC 516 after passing through fifth data driving IC 515 and fourth data driving IC 514.

The first group of signal transmission lines 531, 532 and 533 may each pass through the first group of data driving ICs 511, 512 and 513. The second group of signal transmission lines 534, 535 and 536 may each pass through the second group of data driving ICs 514, 515 and 516.

The signal controller 600 may control operation of the gate driver 400 and the data driver 500.

Operation of the above-described LCD according to an exemplary embodiment of the present invention will now be described in detail.

The signal controller 600 is supplied with input image signals R, G and B, which may correspond to the primary colors represented by the pixels PX, and input control signals for controlling the display thereof from an external graphics controller (not shown). The input image signals R, G and B contain luminance information for pixels PX and the luminance information may define a predetermined number of grays to be emitted from pixels PX, for example, 1024($=2^{10}$), 256($=2^8$), or 64($=2^6$) grays. The input control signals may include a vertical synchronization signal Vsync, a horizontal synchronization signal Hsync, a main clock MCLK, and a digital input-output signal DIO.

On the basis of the input control signals and the input image signals R, G and B, the signal controller 600 may generate gate control signals CONT1 and data control signals CONT2 and may process the input image signals R, G and B to generate processed image signals DAT for the operation of the panel assembly 300 and the data driver 500. The signal controller 600 may send the gate control signals CONT1 to the gate driver 400 and the processed image signals DAT and the data control signals CONT2 to the data driver 500.

Referring to FIG. 3, the signal controller 600 may group the processed image signals DAT into a plurality of groups of image data signals DAT1, DAT2, DAT3, DAT4, DAT5, and DAT6 for respectively driving data driving ICs 511, 512, 513, 514, 515 and 516, and may transmit the groups of the image data signals DAT1, DAT2, DAT3, DAT4, DAT5, and DAT6 to the respective data driving ICs 511, 512, 513, 514, 515 and 516 through the respective data transmission lines 561, 562, 563, 564, 565, and 566. This configuration is referred to as a point-to-point cascading interface, and there is no need for a carry signal for shifting the image data signals DAT1, DAT2, DAT3, DAT4, DAT5, and DAT6 between the data driving ICs 511, 512, 513, 514, 515 and 516.

In addition, the data transmission lines 561, 562, 563, 564, 565, and 566 may transmit the image data signals DAT1, DAT2, DAT3, DAT4, DAT5, and DAT6 in a current form, and for example, a high level of a bit of the image data signals DAT1, DAT2, DAT3, DAT4, DAT5, and DAT6 may be represented by a current value I, while a low level of a bit of the image data signals DAT1, DAT2, DAT3, DAT4, DAT5, and DAT6 may be represented by another current value 3I that may be approximately equal to about three times the current value I for the high level of the bit.

The gate control signals CONT1 may include a scanning start signal STV for instructing the gate driver 400 to start scanning and at least one clock signal for controlling the output period of the gate-on voltage Von. The gate control signals CONT1 may also include an output enable signal OE for defining the duration of the gate-on voltage Von period.

The data control signals CONT2 may include a horizontal synchronization start signal STH for informing the data driver 500 of the start of data transmission for a row of pixels PX, a load signal LOAD for instructing to apply the data signals to the data lines $D_1$ to $D_m$, and a data clock signal HCLK. The data control signal CONT2 may further include an inversion signal RVS for reversing the polarity of the voltage of the data signals relative to the common voltage Vcom.

According to an exemplary embodiment of the present invention, the data control signals CONT2 may include a digital input-output signal DIO that includes the horizontal synchronization start signal STH and the load signal LOAD.

Responsive to the data control signals CONT2 from the signal controller 600, the data driving ICs 511, 512, 513, 514, 515 and 516 may receive a digital packet of the image data signals DAT1, DAT2, DAT3, DAT4, DAT5, and DAT6 for a group of pixels PX from the signal controller 600, convert the image data signals DAT1, DAT2, DAT3, DAT4, DAT5, and DAT6 from digital image data signals into analog image data signals selected from the gray voltages, and apply the analog image data signals to the data lines $D_1$ to $D_m$.

The gate driver 400 may apply the gate-on voltage Von to one of gate lines $G_1$ to $G_n$ in response to the scanning control signals CONT1 from the signal controller 600, thereby turning on the switching transistor Q connected to a gate line $G_i$.

The data signal applied to a data line $D_j$ is then supplied to the pixel PX through the activated switching transistor Q.

The difference between the voltage of an image data signal and the common voltage Vcom applied to a pixel PX is represented as a voltage across the LC capacitor Clc of the pixel PX, which may be referred to as a pixel voltage. The LC molecules in the LC capacitor Clc may be arranged into molecular orientations depending on the magnitude of the pixel voltage, and the molecular orientations may determine the polarization of light passing through the LC layer 3. One or more polarizers may convert the light polarization into the light transmittance such that the pixel PX has a luminance represented by a gray of the image data signal.

By repeating this procedure by a unit of a horizontal period (also referred to as "1H" and equal to one period of the horizontal synchronization signal Hsync), gate lines $G_1$ to $G_n$ may be sequentially supplied with the gate-on voltage Von, to thereby apply the image data signals via data lines $D_1$ to $D_m$ to all pixels PX, sequentially by row, to display an image for a frame.

When the next frame starts after one frame finishes, an inversion control signal RVS applied to the data driver 500 may be controlled to reverse the polarity of the image data signals, known as frame inversion. The inversion control signal RVS may be also controlled to periodically reverse the polarity of the image data signals during a single frame, which may be row inversion or dot inversion, or to reverse the polarity of the image data signals in a packet of image data signals, which may be column inversion or dot inversion.

Methods of driving a display device according to exemplary embodiments of the present invention will be described in detail with reference to FIG. 4, FIG. 5, FIG. 6, FIG. 7, FIG. 8 and FIG. 9.

Figure 4:
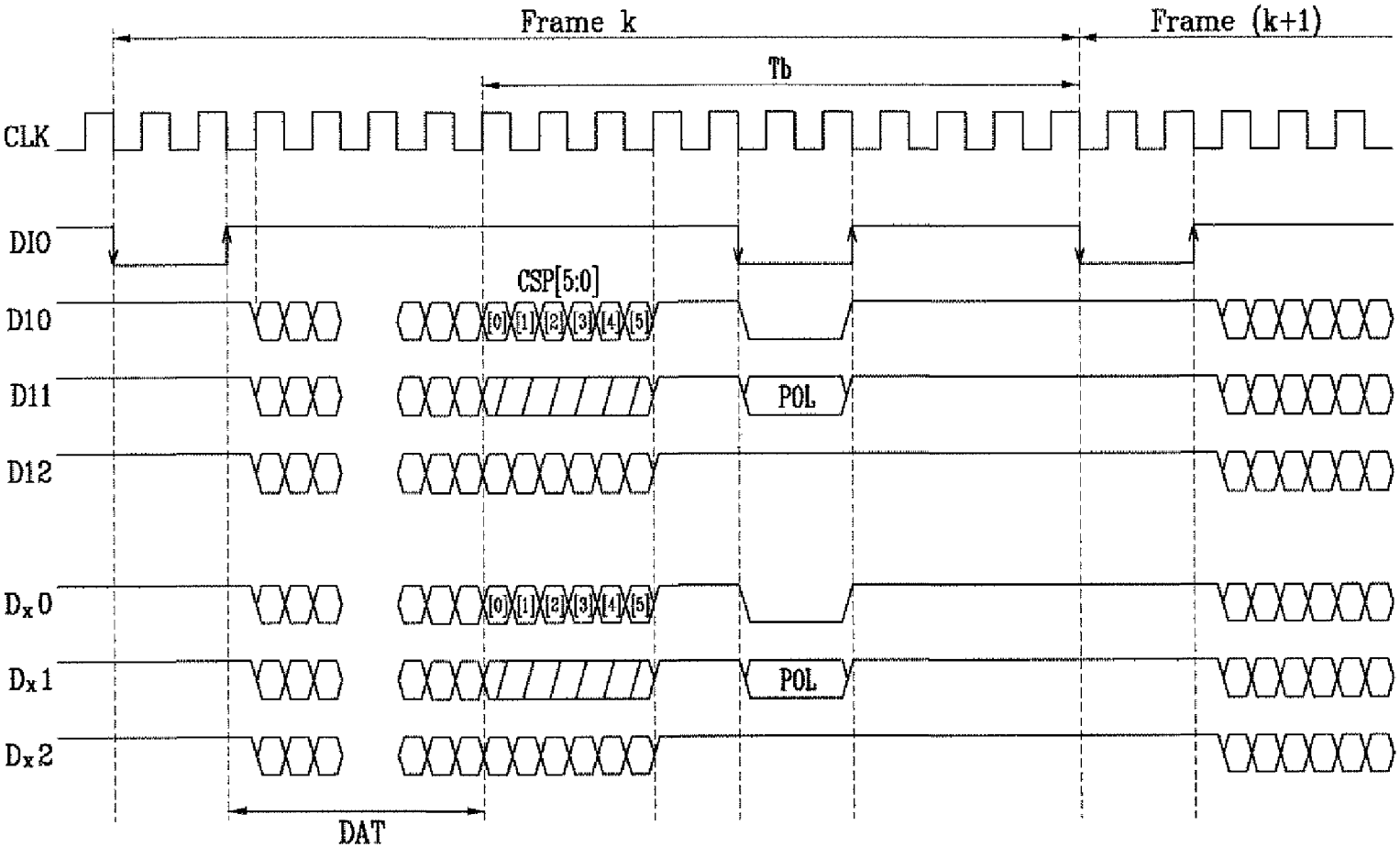
FIG. 4 shows a timing diagram of signals used in an LCD according to an exemplary embodiment of the present invention.
Figure 5:
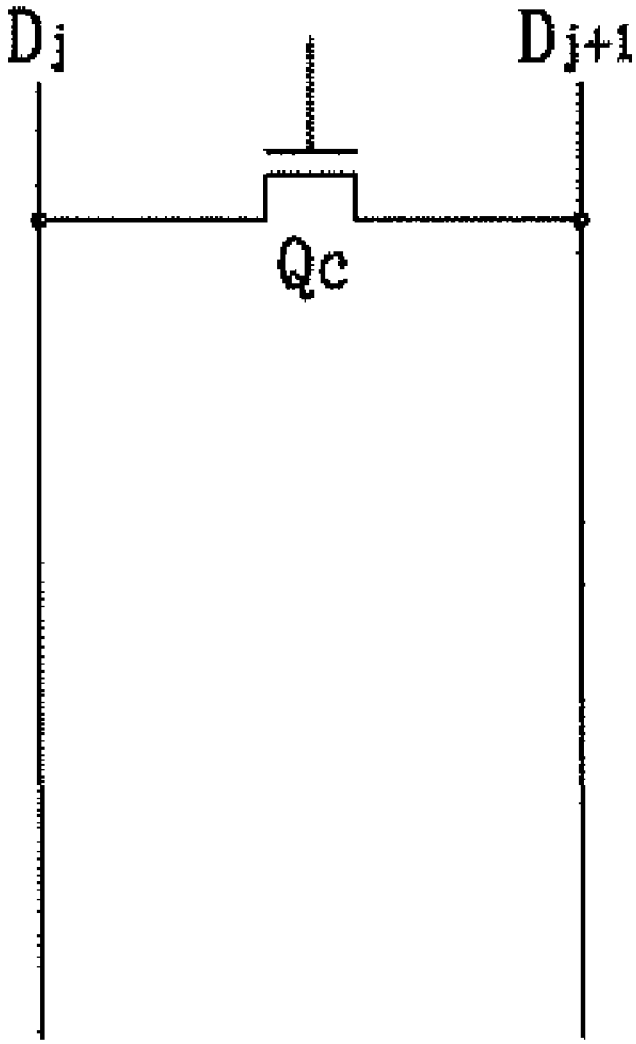
FIG. 5 shows data lines of an LCD according to an exemplary embodiment of the present invention.
Figure 6:
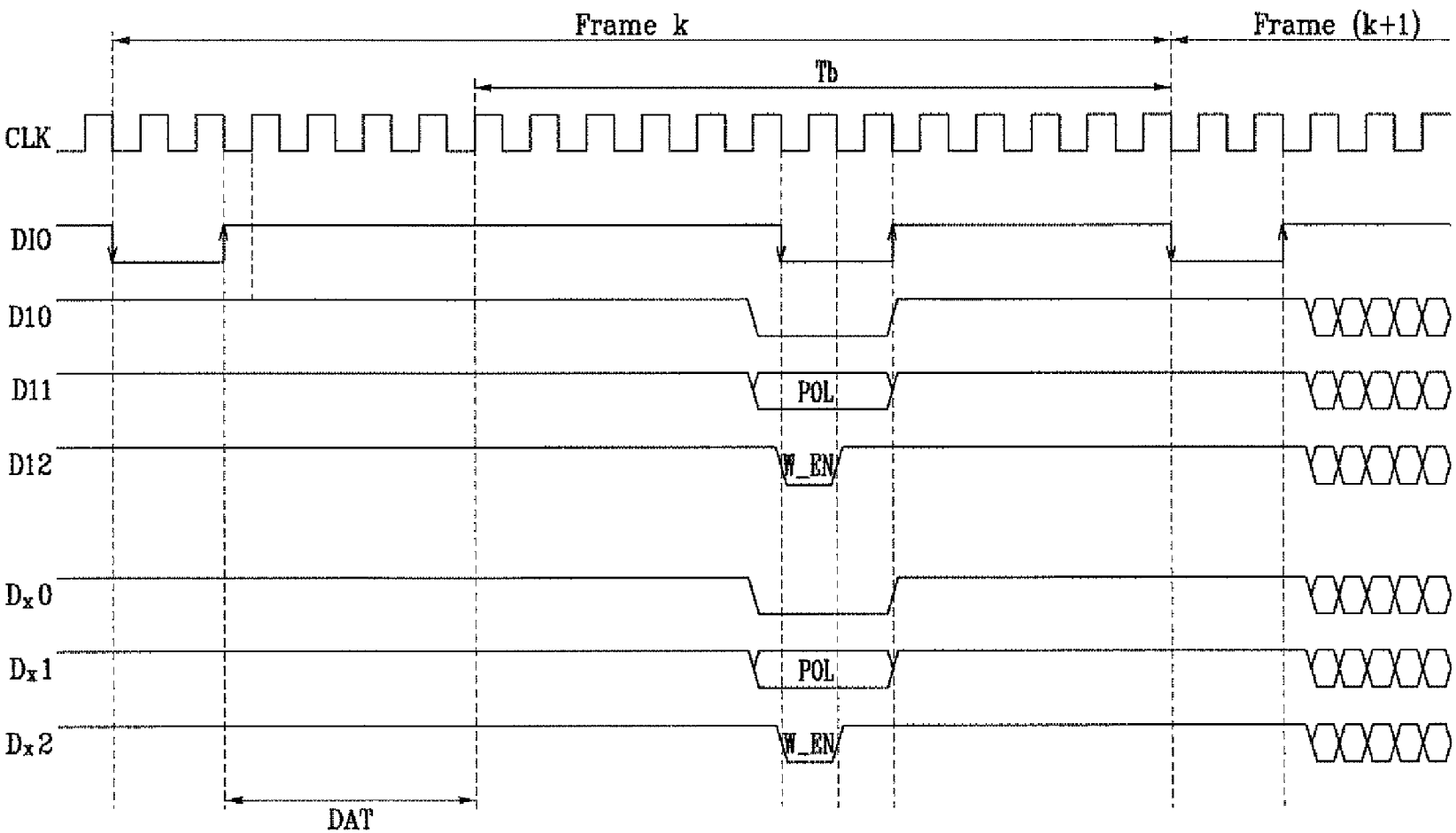
FIG. 6 and FIG. 7 show timing diagrams of signals used in an LCD according to exemplary embodiments of the present invention.
Figure 7:
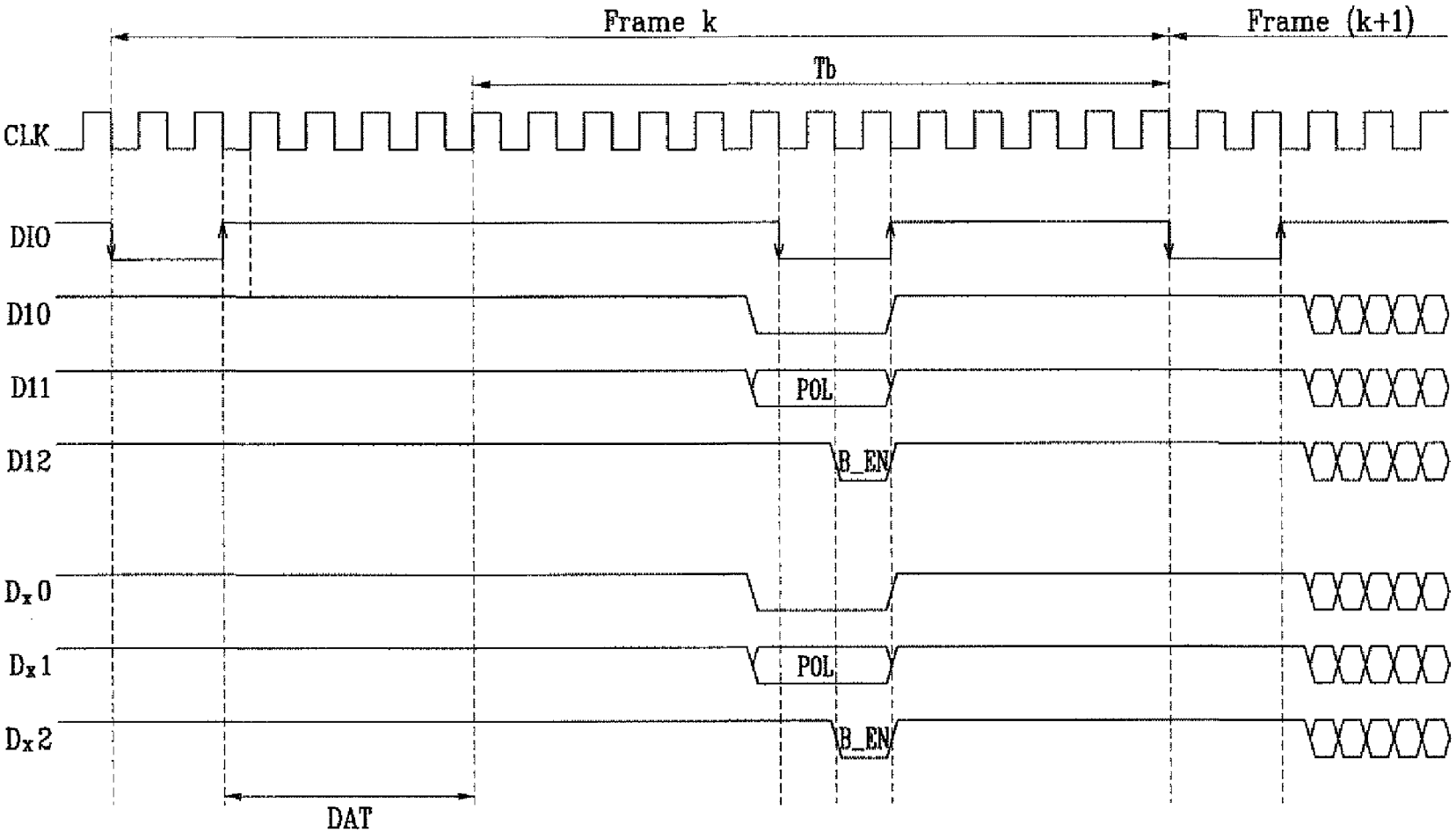

FIG. 4 shows a timing diagram of signals used in an LCD according to an exemplary embodiment of the present invention, FIG. 5 shows data lines of an LCD according to an exemplary embodiment of the present invention, and FIGS. 6 and 7 show timing diagrams of signals used in an LCD according to exemplary embodiments of the present invention.

FIG. 4 shows a clock signal CLK, a digital input-output signal DIO, and signals transmitted by the transmission lines D10 to Dx2. Here, 'x' may denote the number of the data driving ICs 511, 512, 513, 514, 515 and 516. For example, x=6 in the configuration shown in FIG. 3.

Each group of three transmission lines, such as a first group of D10, D11 and D12, may transmit red, green, and blue digital image data. For example, the first transmission line D10 may transmit red R digital image data, the second transmission line D11 may transmit green G digital image data, and the third transmission line D12 may transmit blue B digital image data. Similarly, in a second group of transmission lines as shown in FIG. 4, the first transmission line Dx0 may transmit red R digital image data, the second transmission line Dx1 may transmit green G digital image data, and the third transmission line Dx2 may transmit blue B digital image data.

The transmission of the digital image data may stop during a blank period Tb, and several control signal bits for processing the digital image data may be inserted in the blank period Tb.

An example of such control signals may include a charge sharing control signal CSP for controlling the charge sharing time. An example of the charge sharing may occur where a switching element Qc is coupled between adjacent data lines $D_j$ and $D_{j+1}$ as shown in FIG. 5, and the adjacent data lines $D_j$ and $D_{j+1}$ may share electrical charges when the switching element Qc turns on. The charge sharing control signal CSP may control the turn-on time of the switching element Qc. Another example of the control signals is a polarity signal POL that determines the polarity of data voltages relative to the common voltage Vcom.

When a series of image data DAT for a row of pixels PX represents all white or all black, every bit of the series of processed image signals DAT transmitted from the signal controller 600 to the data driver 500 may have a high value for reducing power consumption. Instead, a control signal bit informing whether the series of processed image signals DAT represent all white or all black may be inserted in synchronization with the polarity signal bit POL.

For example, a white enable signal bit W_EN for informing that the processed image signals DAT are all white or a black enable signal bit B-EN for informing that the processed image signals DAT are all black may be inserted in the signals transmitted by the third transmission line Dx2 in every group of three transmission lines Dx0-Dx2, as shown in FIG. 6 and FIG. 7. Since the polarity signal bit POL may occupy about two periods of a clock signal, the first clock may be assigned to the white enable signal W_EN while the second clock may be assigned to the black enable signal B_EN, or vice versa.

In addition, when a series of processed image signals DAT for a row of pixels PX represents all white or all black, the charge sharing control signal CSP bits may not be inserted to prevent the data voltages flickering from charge sharing, thereby further reducing the power consumption.

Figure 8:
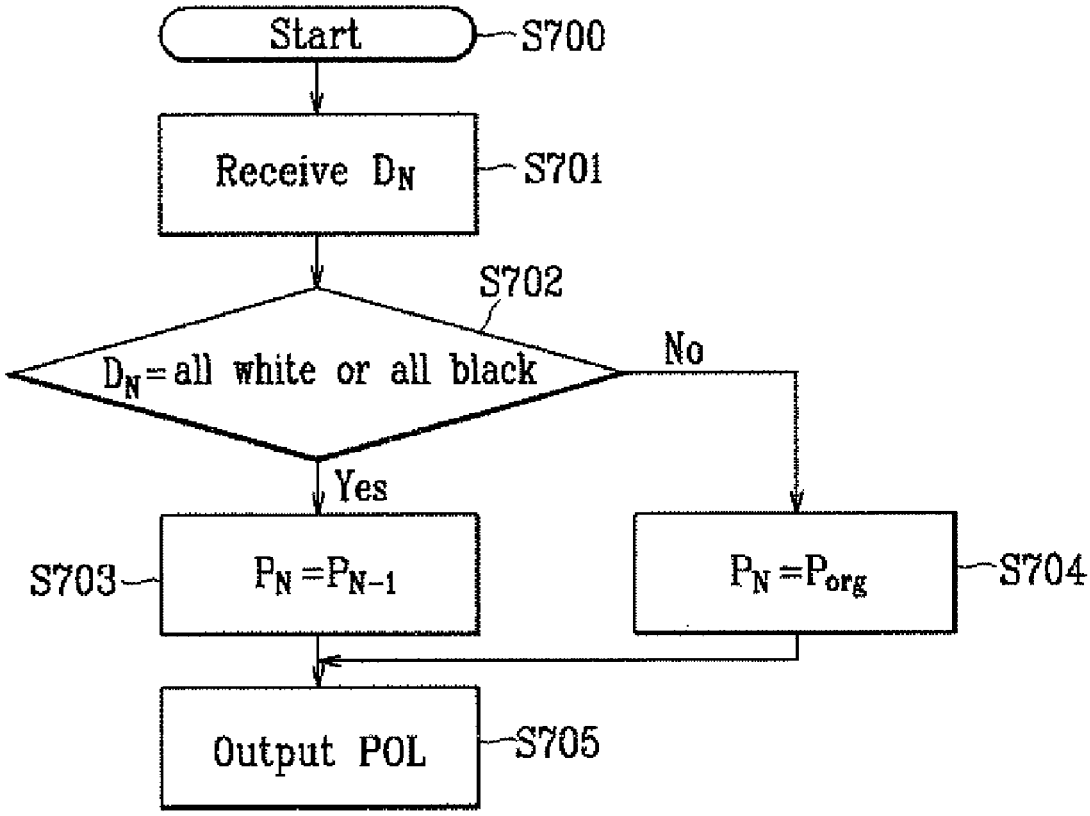
FIG. 8 shows a flow chart illustrating an operation of an LCD according to another exemplary embodiment of the present invention.

FIG. 8 shows a flow chart illustrating an operation of an LCD according to another exemplary embodiment of the present invention.

Here, "$D_N$" denotes image data for a row of pixels in a frame, "$P_{org}$" denotes a polarity data "originally assigned" to the image data $D_N$, "$P_N$" denotes a polarity data for the image data $D_N$, and "$P_{N-1}$" denotes a polarity data for the image data $D_{N-1}$ for a previous row of pixels.

The "originally assigned" polarity data $P_{org}$ means polarity information for the image data $D_N$ resulting from a polarity inversion type such as a dot inversion or a row inversion given for the LCD.

First, the signal controller 600 receives image data $D_N$ for a row of pixels (S701). An original polarity data $P_{org}$ for the image data $D_N$ is predetermined according to the polarity inversion type.

Next, the signal controller 600 determines whether the image data $D_N$ are one of all white and all black (S702). If the image data $D_N$ are all white or all black, the polarity data $P_N$ is set to be equal to a polarity data $P_{N-1}$ for the image data $D_{N-1}$ given to a previous row of pixels (S703). When the image data $D_N$ are neither all white nor all black, the polarity data $P_N$ is determined to be equal to the original polarity data $P_{org}$ (S704). Finally, the signal controller 600 outputs the polarity signal POL determined as described above (S705).

To summarize, whether the image data $D_N$ will have an originally assigned polarity is determined by whether or not the image data $D_N$ represent all white or all black. When the image data $D_N$ represent all white or all black, the image data $D_N$ have a polarity equal to that of the image data $D_{N-1}$ for the previous pixel row, instead of the originally assigned polarity $P_{org}$. Then, the swing of the polarity signal from a high value to a low value or vice versa is prevented to reduce the power consumption.

Figure 9:
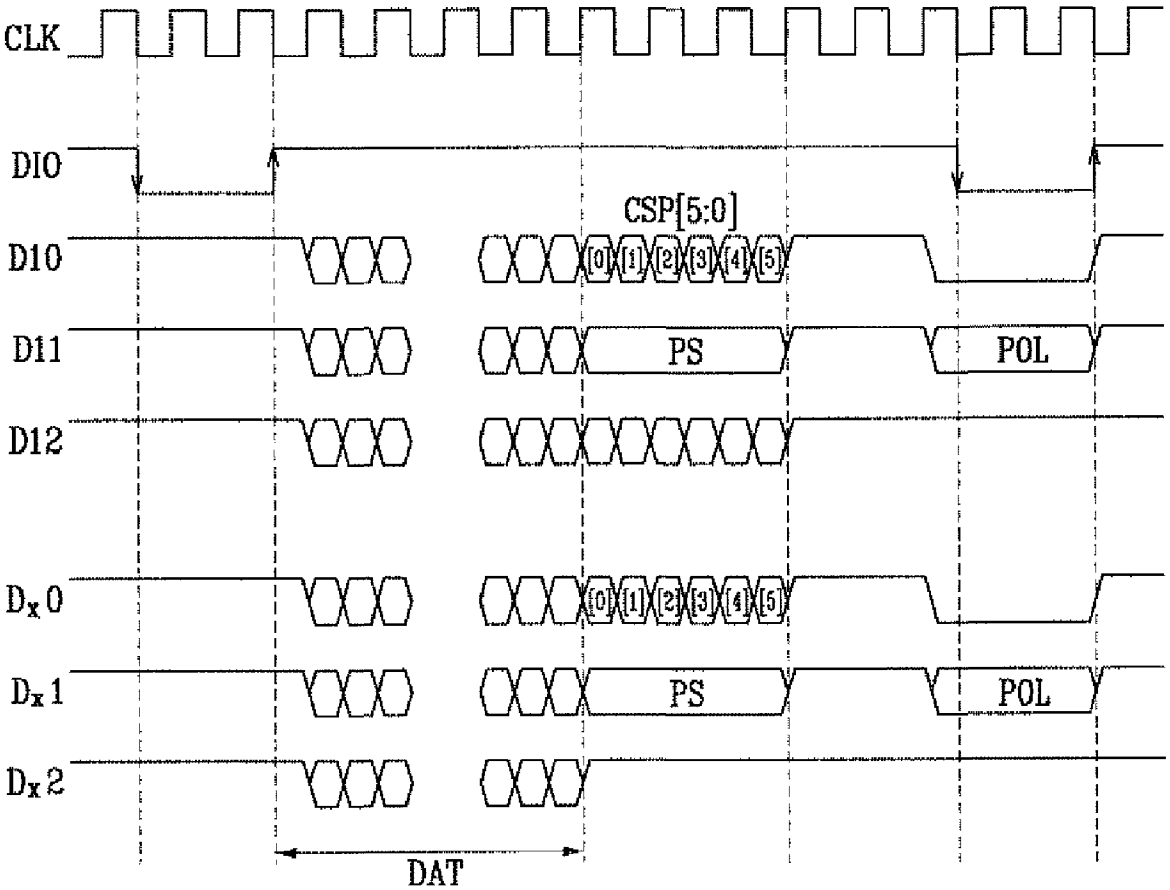
FIG. 9 shows a timing diagram of signals used in an LCD according to another exemplary embodiment of the present invention.

FIG. 9 shows a timing diagram of signals used in an LCD according to another exemplary embodiment of the present invention.

FIG. 9 shows a clock signal CLK, a digital input-output signal DIO, and signals transmitted by the transmission lines D10-Dx2 including processed image signals DAT, a charge sharing control signal CSP, and a polarity signal POL. In addition, the second transmission line Dx1 of every group of three transmission lines may transmit a power save control signal PS.

The power save control signal PS may control a delay locked loop (DLL) (not shown) in the data driving ICs 511, 512, 513, 514, 515 and 516. The DLL may be used for clock synchronization in high frequency operation with a high frequency equal to or higher than about 100 MHz. The DLL may not be used when the data driving ICs 511, 512, 513, 514, 515 and 516 operate with a frequency lower than about 100 MHz. Accordingly, when the operating frequency of the data driving ICs 511, 512, 513, 514, 515 and 516 may be lower than about 100 MHz, the DLL may stop in response to the power save control signal PS to reduce the power consumption. For example, the DLL may operate when the power save control signal PS has a high value, and the DLL may stop its operation when the power save control signal PS has a low value, such that the power of the display device is efficiently used in consideration of the operation frequency.

As described above, when the processed image signals DAT for pixels PX in a pixel row are all white or all black, the processed image signals DAT are transmitted in high voltage levels with accompanying a white enable signal W_EN or a black enable signal B_EN or the polarity signal POL stays at its previous value, and when the operation frequency is lower than a predetermined value, the DLL stops its operation, thereby reducing the power consumption. The above-described operations may be performed independently or all together. In particular, since the display device according to the exemplary embodiments of the present invention employs a point-to-point cascading interface, the data driving ICs 511, 512, 513, 514, 515 and 516 can be individually controlled by the above-described operations. For example, when only the processed image signals DAT provided for two data driving ICs 511 and 516 are all white, the above-described operations may be performed only for the two data driving ICs 511 and 516.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A display device, comprising:

a plurality of pixels arranged in a matrix;

a plurality of data lines coupled with the pixels;

a switching element coupled between a first data line and a second data line adjacent to the first data line;

a signal controller configured to process input image signals and configured to output output image signals;

a gray voltage generator configured to generate a plurality of gray voltages; and a data driver configured to select data voltages from the gray voltages corresponding to the output image signals received from the signal controller, and configured to apply the data voltages to the data lines, wherein when either all bits of the input image signal have a first value or all bits of the input image signal have a second value, the signal controller outputs the output image signal, all bits of the output image signal having the first value, and wherein the signal controller generates and outputs a switching control signal for controlling the switching element, and the signal controller does not output the switching control signal when all bits of the output image signal have the first value.

2. The display device of claim 1, wherein the signal controller further generates an identification signal informing whether all bits of the input image signal have the first value or all bits of the input image signal have the second value.

3. The display device of claim 2, wherein the data driver selects the data voltages depending on the identification signal.

4. The display device of claim 3, wherein the first value is a highest available value and the second value is a lowest available value.

5. The display device of claim 1, wherein the data driver comprises a plurality of integrated circuits, and the integrated circuits are coupled with the signal controller in a point-to-point cascading interface.

6. The display device of claim 5, wherein the integrated circuits include a plurality of groups of integrated circuits, and the integrated circuits in a first group of integrated circuits are coupled with each other and are disconnected from the integrated circuits in a second group of integrated circuits.

7. The display device of claim 6, wherein the input image signals are applied to pixels arranged in a row.

8. The display device of claim 7, wherein the signal controller and the data driver communicate with each other using a current representation scheme.

9. The display device of claim 8, wherein a current value representing the output image signals having the first value is smaller than a current value representing the output image signals having the second value.

10. The display device of claim 9, wherein the signal controller generates a polarity signal for determining a polarity of the data voltages.

11. The display device of claim 10, wherein the signal controller simultaneously outputs the identification signal and the polarity signal.

12. A display device, comprising:

a plurality of pixels arranged in a matrix;

a plurality of data lines coupled with the pixels;

a switching element coupled between a first data line and a second data line adjacent to the first data line;

a signal controller configured to process input image signals into output image signals;

a gray voltage generator configured to generate a plurality of gray voltages; and a data driver configured to select data voltages from the gray voltages corresponding to the output image signals output from the signal controller, and configured to apply the data voltages to the data lines in sequence, wherein the signal controller generates a polarity signal for determining a polarity of the data voltages, and when either all bits of the input image signal have a first value or all bits of the input image signal have a second value, data voltages corresponding to the input image signals applied to a row of pixels have the same polarity as data voltages applied to the previous row of pixels, and wherein the signal controller generates and outputs a switching control signal for controlling the switching element, and the signal controller does not output the switching control signal when all bits of the output image signal have the first value.

13. The display device of claim 12, wherein the first value is a highest available value and the second value is a lowest available value.

14. The display device of claim 12, wherein the data driver comprises a plurality of integrated circuits, and the integrated circuits are coupled with the signal controller in a point-to-point cascading interface.

15. The display device of claim 14, wherein the integrated circuits include a plurality of groups of integrated circuits, and the integrated circuits in a first group of integrated circuits are coupled with each other, and are disconnected from the integrated circuits in a second group of integrated circuits.

16. The display device of claim 12, wherein the signal controller and the data driver communicate with each other using a current representation scheme.

* * * * *